US007175394B2

(12) United States Patent
Butler

(10) Patent No.: US 7,175,394 B2
(45) Date of Patent: Feb. 13, 2007

(54) HYDRAULIC MULTIPHASE PUMP

(75) Inventor: Bryan Virge Butler, Garrison, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 576 days.

(21) Appl. No.: 10/621,108

(22) Filed: Jul. 15, 2003

(65) Prior Publication Data

US 2004/0091363 A1 May 13, 2004

Related U.S. Application Data

(63) Continuation-in-part of application No. 10/036,737, filed on Dec. 21, 2001, now Pat. No. 6,592,334.

(51) Int. Cl.
*F04B 49/00* (2006.01)

(52) U.S. Cl. ..... 417/53; 417/46

(58) Field of Classification Search ..... 417/342
See application file for complete search history.

(56) References Cited

U.S. PATENT DOCUMENTS

| | | | | |
|---|---|---|---|---|
| 3,583,282 A | | 6/1971 | Cope | 91/25 |
| 3,922,116 A | | 11/1975 | Pugh | 417/393 |
| 5,344,290 A | | 9/1994 | Benckert | 417/342 |
| 5,622,478 A | | 4/1997 | Elliott et al. | 417/53 |
| 5,634,773 A | | 6/1997 | Tanino et al. | 417/46 |
| 5,660,532 A | | 8/1997 | Castel | 417/342 |
| 6,126,413 A | * | 10/2000 | Berke-Jorgensen | 417/401 |
| 6,171,075 B1 | | 1/2001 | Munzenmaier et al. | 417/342 |
| 6,592,334 B1 | | 7/2003 | Butler | 417/46 |

FOREIGN PATENT DOCUMENTS

| | | |
|---|---|---|
| EP | 0 141 930 | 5/1985 |
| GB | 2 183 303 | 6/1987 |

* cited by examiner

*Primary Examiner*—Anthony D. Stashick
*Assistant Examiner*—Samuel E. Belt
(74) *Attorney, Agent, or Firm*—Patterson & Sheridan, L.L.P

(57) ABSTRACT

The present invention provides a hydraulically driven multiphase pump system and methods for pumping a fluidstream from the surface of a well. The hydraulically driven multiphase pump system consists of two vertically disposed plungers. The plungers are hydraulically controlled and actuated to work in alternate directions during a cycle using a closed loop hydraulic system. Each cycle is automatically re-indexed to assure volumetric balance in the circuits. An indexing circuit ensures that each plunger reaches its full extended position prior to the other plunger reaching its preset retracted position. A power saving circuit is used to transfer energy from the extending plunger to the retracting plunger. A trim circuit is used to ensure a proper fluid level in the indexing circuit and the power saving circuit. Additionally, a rapid reversal circuit may be employed to increase the rate of the two vertically disposed plungers.

21 Claims, 7 Drawing Sheets

HYDRAULIC MULTIPHASE PUMP

CROSS-REFERENCE TO RELATED APPLICATIONS

This application is a continuation-in-part of U.S. patent application Ser. No. 10/036,737, filed on Dec. 21, 2001, now U.S. Pat. No. 6,592,334 entitled "Hydraulic Multiphase Pump," which patent application is herein incorporated by reference.

BACKGROUND OF THE INVENTION

1. Field of the Invention

The present invention generally relates to an apparatus and method used to transport hydrocarbons from a wellbore to another location. More particularly, the invention relates to a multiphase pump for transporting hydrocarbons from the surface of a producing well. More particularly still, the invention relates to a pump having two vertically disposed plungers and circuitry providing more efficient operation of the pump.

2. Description of the Related Art

Oil and gas wells include a wellbore formed in the earth to access hydrocarbon bearing formations. Typically, a borehole is initially formed and thereafter the borehole is lined with steel pipe, or casing in order to prevent cave in and facilitate the isolation of portions of the wellbore. To complete the well, at least one area of the wellbore casing is perforated to form a fluid path for the hydrocarbons that either flow upwards to the surface of the well due to naturally occurring formation pressure or are urged upwards with some form of artificial lift. Regardless of the manner in which the hydrocarbons reach the surface of the well, this flow will arrive as a mixture of oil, gas, dirt and sand which is referred to as a "wellstream" or "fluidstream". The fluidstream is then transported by a flowline to a predetermined location, such as a separator where it may be separated into gas, liquids, and solids. If the fluidstream cannot flow to the separator, it may be pumped by a multiphase pump. These pumps must be capable of moving volumes of the oil, gas, water or other substances making up the fluidstream. The pumps can be located offshore or onshore and can be connected to a single or multiple wellheads through the use of a manifold.

Over the past 20 years, two principle types of rotary pumps have been used as multiphase pumps: the twin screw pump and the helico-axial pump. The twin screw pump is a positive displacement pump constructed basically of two intermeshing screws. The fluidstream enters the pump from the wellhead and is trapped between the screws of the pump. The rotation of two screws forces the fluidstream into the downstream flowline. The helico-axial style pump combines positive displacement with dynamic compression and is basically constructed of turbine blades in combination with a screw drive. This combination imparts energy from turbine blades and the screw drive into the discharged fluids.

The rotary style multiphase pumps have been popular due to their long market exposure but have demonstrated deficiencies. Maintenance problems that usually require more than 24 hours to resolve is one deficiency that affects both the twin screw pump and the helico-axial pump. Many of these problems are associated with erosion or heat that damage the mechanical seals. Sand can also erode the screws and liners of the pumps. Excessive amounts of gas can cause a reduction in the dynamic performance occur in the helico-axial pumps and can lead to build up and gas locking in the twin screw pumps. Conversely, excessively long liquid slugs can affect the efficiency of the helico-axial pumps.

A horizontal, reciprocating pump has been successfully deployed for low to medium gas volume fraction applications. This pump contains horizontal rams that are moved in and out by a rotating crankshaft. The pump has reasonable tolerance for sand in the well stream. It uses replaceable liners to cover and protect the compression cylinders which can be changed in the field. Even though the horizontal reciprocating pump overcomes some of the deficiencies of a rotary style multiphase pump it may experience dynamic problems if the flow is mainly gas.

More recently, a vertical reciprocating pump (the RamPump™) has been used to transport well stream. This pump was introduced to overcome deficiencies of rotary pumps. It operates at a slower pace than the rotary pumps, using larger volume chambers and long strokes to attain the flow rates desired. Due to the slow fluid velocities and vertical plunger design, sand and other impurities from a wellbore have little adverse effect on its moving parts. Because it has no rotating mechanical seals; it can handle a full range of fluid mixtures without requiring liquid trapping or re-circulation to insure seal survival. Preferably driving cylinders are placed in line with their respective plungers. Power fluid supplied from a pressure compensated pump is used to drive one plunger fully down, triggering a sudden pressure increase at the end of the stroke. This pressure spike is used to shift a shuttle valve, causing the swash plate of the compensated pump to reverse angle and to redirect the power fluid to the opposite cylinder. Each power circuit is connected to the piston end of one cylinder and also to the rod end of the other cylinder, thus assuring that the opposite plunger will be driven upward when the first plunger is moving downward.

Even though the vertical RamPump™ overcomes many of the deficiencies in the prior pumps, problems still exist with the use of vertical plungers in a hydraulically driven multiphase pump. For example, if a deficit of hydraulic fluid occurs, the pump will pause, and go to neutral, and may need intervention to restart. In another example, pressure spikes created during the operation of the hydraulically driven pump can cause premature failures in relief valves and hoses at the end fittings. These pressure spikes occur when one of the plungers reaches its preset retracted position and thereby causing the fluid to be further compressed in the hose without any way of escape. This increase pressure is utilized in the system to cause the swash plate in the pressure compensated pump to reverse angle thereby redirecting the flow of hydraulic fluid to the opposite cylinder. Since the swash plate does not change direction instantaneously, the pressure continues to increase in the hoses thereby causing a very high pressure spike resulting in failure of hydraulic components. In yet another example, when an inlet pressure is insufficient to raise the ascending plunger ahead of the descending plunger the pump begins to short stroke on subsequent cycles and ultimately stop pumping. The combination of these problems greatly reduced the functionality of hydraulically driven multiphase pump.

In view of the deficiencies of currently available hydraulically driven multiphase pump a need exists for a hydraulically driven pump that operates effectively and efficiently in pumping multiphase liquids and does not systematically pause during a pumping cycle. There is a further need for a hydraulically driven multiphase pump that is not subject to premature failure of hydraulic components and hoses. There is yet a further need for a hydraulically driven multiphase pump that does not short stroke while operating in various pressure conditions.

SUMMARY OF THE INVENTION

The present invention provides a hydraulically driven multiphase pump system with improved efficiency due to elimination of pressure spikes and priming problems of the plunger moving toward the extended position. The hydraulically driven multiphase pump system consists of two vertical disposed plungers. The plungers are hydraulically controlled and actuated to work in alternate directions during a stroking cycle using a closed loop hydraulic system. Each cycle is automatically re-indexed to assure volumetric balance in the circuits. An indexing circuit ensures that each plunger reaches its full extended position prior to the other plunger reaching its preset retracted position. The multiphase pump system is capable of operating in 100% gas and 100% liquids without requiring auxiliary liquid circuits.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
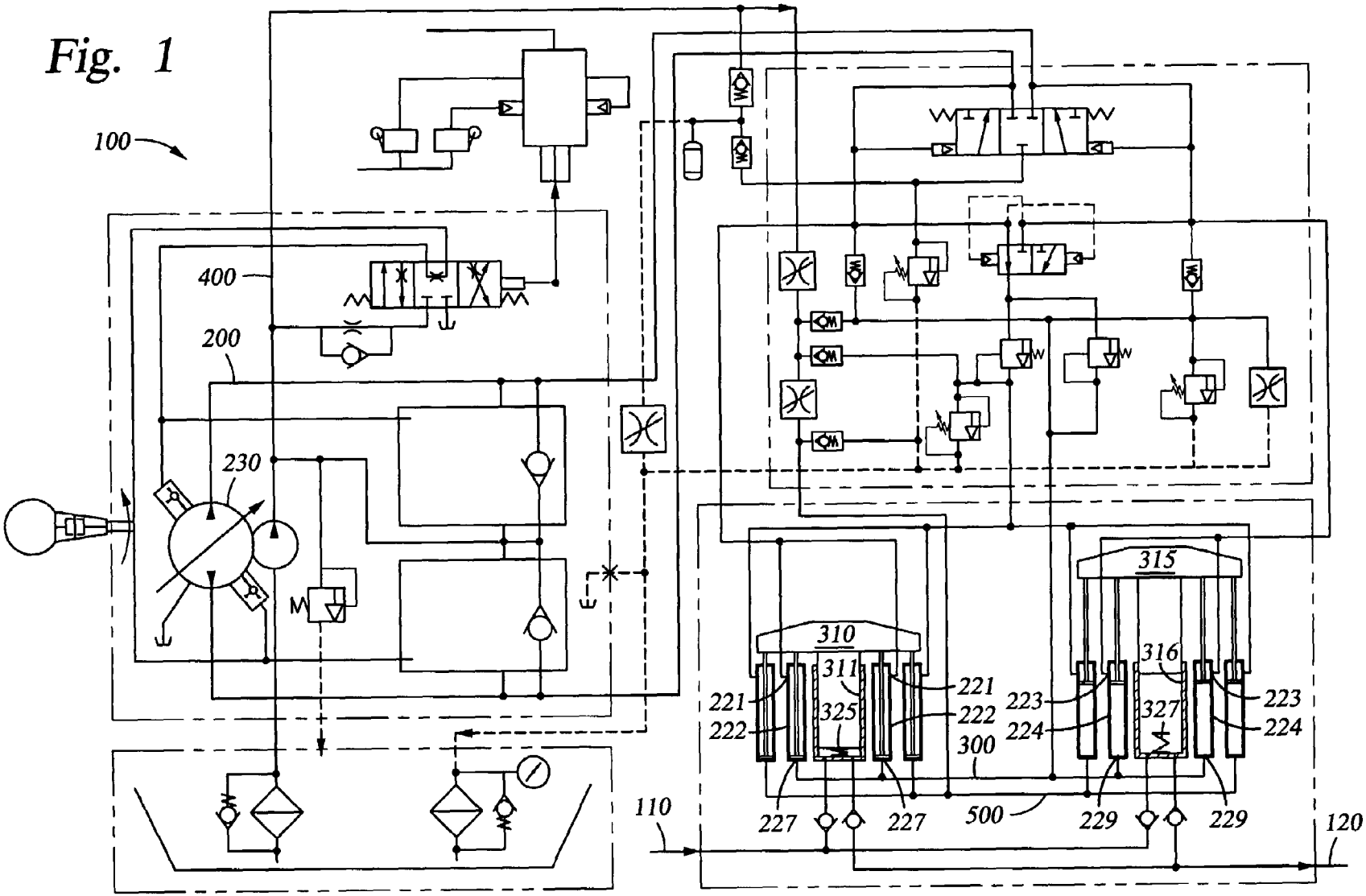
FIG. 1 is a schematic view of a complete hydraulically driven multiphase pump system.

FIG. 1 is a schematic view of a complete hydraulically driven multiphase pump system 100. For ease of explanation the invention will be first be described generally with respect to FIG. 1, thereafter more specifically with FIGS. 2–7. The system 100 contains a first 310 and second 315 plunger, each movable between an extended position and a retracted position. The first plunger 310 is moveable by a first and a second hydraulic cylinders 222. The second plunger 315 is movable by a first and a second hydraulic cylinders 224. When the first plunger 310 is moving toward the extended position, a suction is created by the plunger 310, urging the fluidstream from the wellbore to enter the system 100 through an inlet 110 and fill a first plunger cavity 311. Simultaneously, the second plunger 315 is moving in an opposite direction toward a preset retracted position, thereby expelling the fluidstream in a second plunger cavity 316 to a discharge 120. As the first plunger 310 reaches its full extended position, the second plunger 315 then reaches its preset retracted position, thereby completing a cycle. The first plunger 310 then moves toward the preset retracted position expelling the fluidstream into the discharge 120, as the second plunger 315 moves toward the extended position creating a suction and urging the fluidstream to enter the inlet 110. In this manner, the plungers operate as a pair of substantially counter synchronous fluid pumps. While the described embodiment includes plungers acting in a counter-synchronous manner, it will be understood that so long as they move in a predetermined way relative to one another, a predetermined phase relationship, the plungers can assume any position as they operate.

The plungers 310, 315 move in the opposite directions causing continuous flow of fluid from the inlet 110 to the discharge 120. A first biasing member 325 is disposed at the lower end of the first plunger 310, to facilitate the movement of the first plunger 310 toward the extended position. A second biasing member 327 is disposed at the lower end of the second plunger 315 to facilitate the movement of the second plunger 315 toward the extended position. The hydraulic cylinders 222, 224 are shown on the side of the plungers 310, 315, which is a preferred embodiment. However, this invention is not limited to orientation of the hydraulic cylinders 222, 224 as shown on FIG. 1. For instance, depending on space requirement the plungers can be disposed in any orientation that is necessary and effective.

The system 100 includes a power fluid circuit which is referred to as a closed loop circuit 200 for supply of hydraulic fluid from a pressure compensated pump 230 to a rod end 221 of the first and the second hydraulic cylinders 222 of the first plunger 310 and to a rod end 223 of the first and the second hydraulic cylinders 224 of the second plunger 315. The system 100 also includes an indexing circuit 300 providing hydraulic fluid to and from a blind end 227 of the first and the second hydraulic cylinders 222 of the first plunger 310 and to a blind end 229 of the first and the second hydraulic cylinders 224 of the second plunger 315. The indexing circuit 300 ensures that one plunger reaches its full extended position prior to the other plunger reaching its preset retracted position. Additionally, the system 100 further includes a power saving circuit 500 to transfer energy between the first 310 and the second 315 plunger. The system 100 further includes a charge circuit 400 for providing hydraulic fluid to the closed loop circuit 200, the indexing circuit 300 and the power saving circuit 500.

Figure 2:
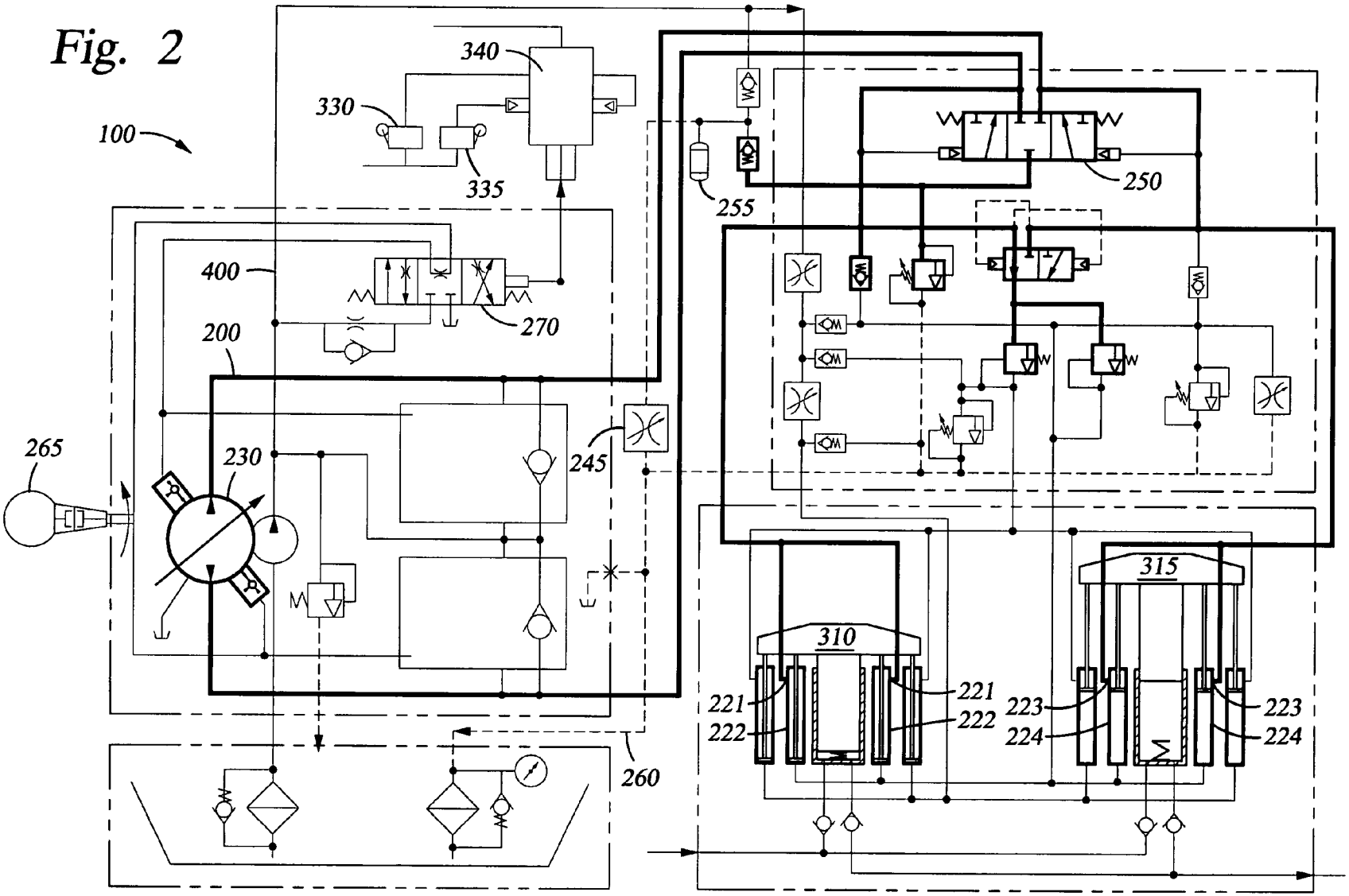
FIG. 2 is a schematic view showing a closed loop circuit in the hydraulically driven multiphase pump system.

FIG. 2 is a schematic view showing the closed loop circuit 200 in the hydraulically driven multiphase pump system 100. In the circuit 200, the rod end 221 of the first and the second hydraulic cylinders 222 of the first plunger 310 and to the rod end 223 of the first and the second hydraulic cylinders 224 of the second plunger 315 is connected to the pressure compensated hydraulic pump 230. The pump 230 is energized by an external power source 265 such as an electric motor or an engine. The circuit 200 further includes a first 330 and a second 335 limit switch to commence the reversal of fluid flow by the pressure compensated hydraulic pump 230. During a cycle, the pump 230 directs hydraulic fluid towards the first and the second hydraulic cylinders 222 of the first plunger 310 thereby causing the plunger 310 to move towards the retracted position. Once the plunger 310 reaches the preset retracted position, the limit switch 330 is triggered. The first 330 and the second 335 limit switches are arranged and constructed to trigger a signal to box 340. The box 340 is connected to a control valve 270 which causes the pressure compensated pump 230 to redirect the flow of fluid in the closed loop circuit 200. When redirected, the pump 230 draws the fluid from the rod end 221 the first and the second hydraulic cylinders 222 of the first plunger 310 in the retracted position and sends the fluid to the rod end 223 of the first and the second hydraulic cylinders 224 of the second plunger 315 in the extended position, thereby completing a cycle. The first 330 and the second 335 limit switches are movable to adjust the first 310 and the second 315 plunger preset retracted positions in order to optimize the pump cycle. The pump system is optimized when the volume of well stream pumped over time is increased.

In the event the circuit 200 experiences leakage through a loop flushing valve 245 or through normal leakage from the compensated pump 230 to a drain 260, a replenishment flow of fluid can be introduced into the closed loop circuit 200 by means of the charge circuit 400. The charge circuit 400 includes an accumulator 255 that stores fluid under pressure. A valve 250 between the accumulator 255 and the closed loop circuit 200 permits fluid introduction to the closed loop circuit 200 in the event that fluid pressure in the circuit 200 falls below a preset valve.

Figure 3:
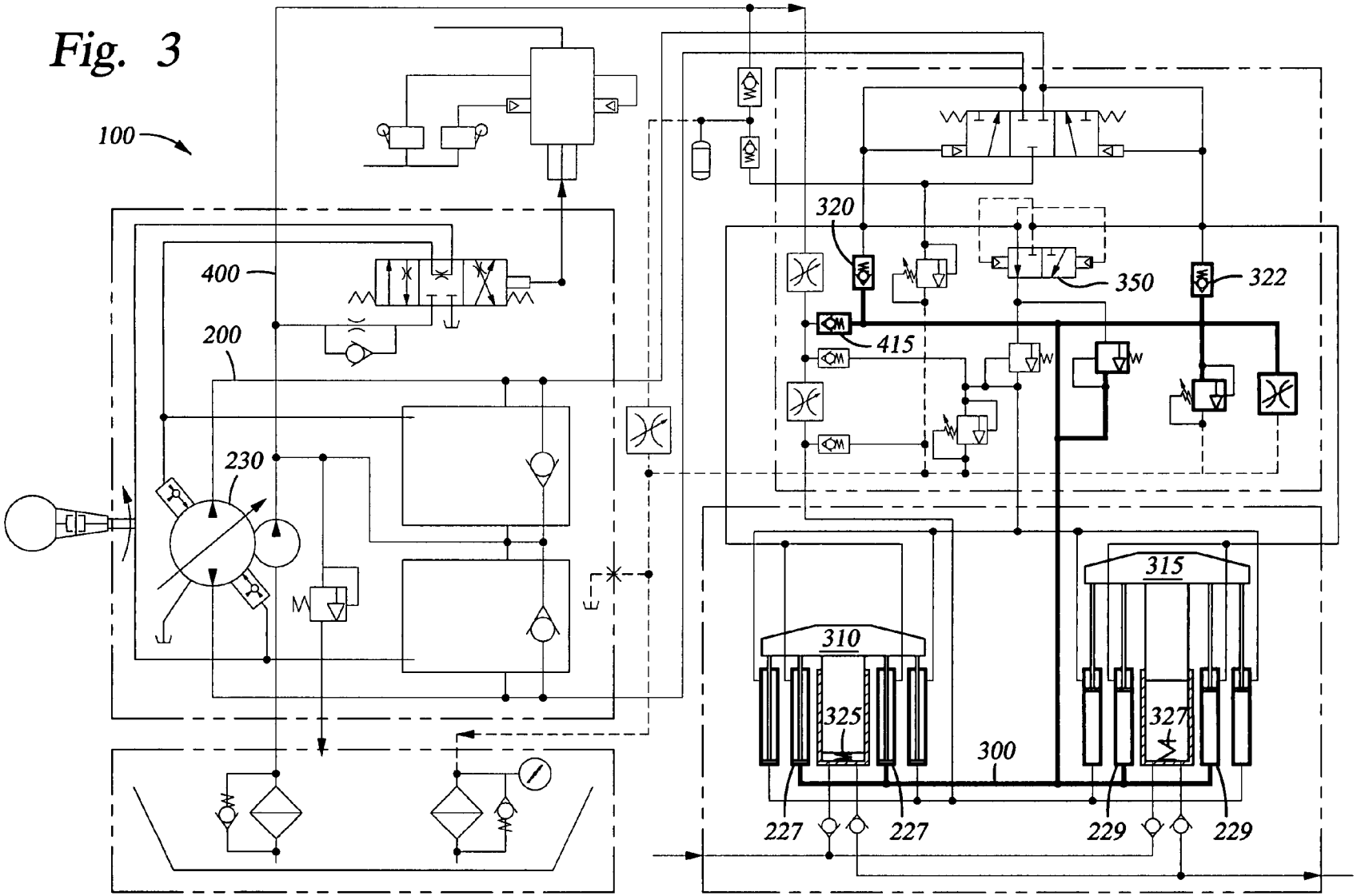
FIG. 3 is a schematic view showing an indexing circuit in the hydraulically driven multiphase pump system.

FIG. 3 is a schematic view showing the indexing circuit 300 in the hydraulically driven multiphase pump system 100. The indexing circuit 300 ensures that each plunger reaches its full extended position prior to the other plunger reaching its preset retracted position. Circuit 300 connects the blind end 227 of the first and the second hydraulic cylinders 222 of the first plunger 310 to the blind end 229 of the first and the second hydraulic cylinders 224 of the second plunger 315. In a low inlet pressure scenario, the extending plunger has less external force urging it toward the extended position. To compensate, the pressure increases in the indexing circuit 300 thereby preventing fluid introduction by the charge circuit 400. One feature to address this problem is the use of an acceleration valve 350 for selective communication with the closed loop circuit 200 and the indexing circuit 300. As the pump system 100 completes a cycle and one of the plungers moves from the extended position to the retracted position, the acceleration valve 350 briefly provides a small volume of fluid from the closed loop circuit 200 to the indexing circuit 300. This fluid entering the indexing circuit 300 accelerates the movement of the plunger towards its extended position, thereby assuring that the plunger will reach its full extended position prior to the time the other plunger reaches its preset retracted position. A second feature in the preferred embodiment for low inlet pressures is the use of the first 325 and the second 327 biasing member for biasing at least one of the plungers as the plunger moves from the retracted position. The first biasing member 325 propels the first plunger 310 towards the extended position, thereby temporarily lowering pressure in the indexing circuit 300 below the pressure in the charge circuit 400. A first pressure sensing member 415 in the charge circuit 400 opens and introduces fluid to the indexing circuit 300. This fluid further ensures that the plunger moving toward the extended position will arrive prior to the time the other plunger reaches its preset retracted position. Likewise, upon reversal of pump 230, the second biasing 327 member propels the second plunger 315 toward the extended position thereby following the same sequence of events as described.

The indexing circuit 300 further includes a first 320 and a second 322 check valve for selective communication from the indexing circuit 300 to the close loop circuit 200. The first 320 and second 322 check valves are arranged to allow fluid to enter the suction line of pressure compensated pump 230 in the closed loop circuit 200 as one plunger reaches its full extended position while the other plunger proceeds to its preset retracted position thereby maintaining volumetric balance in the system 100.

Figure 4:
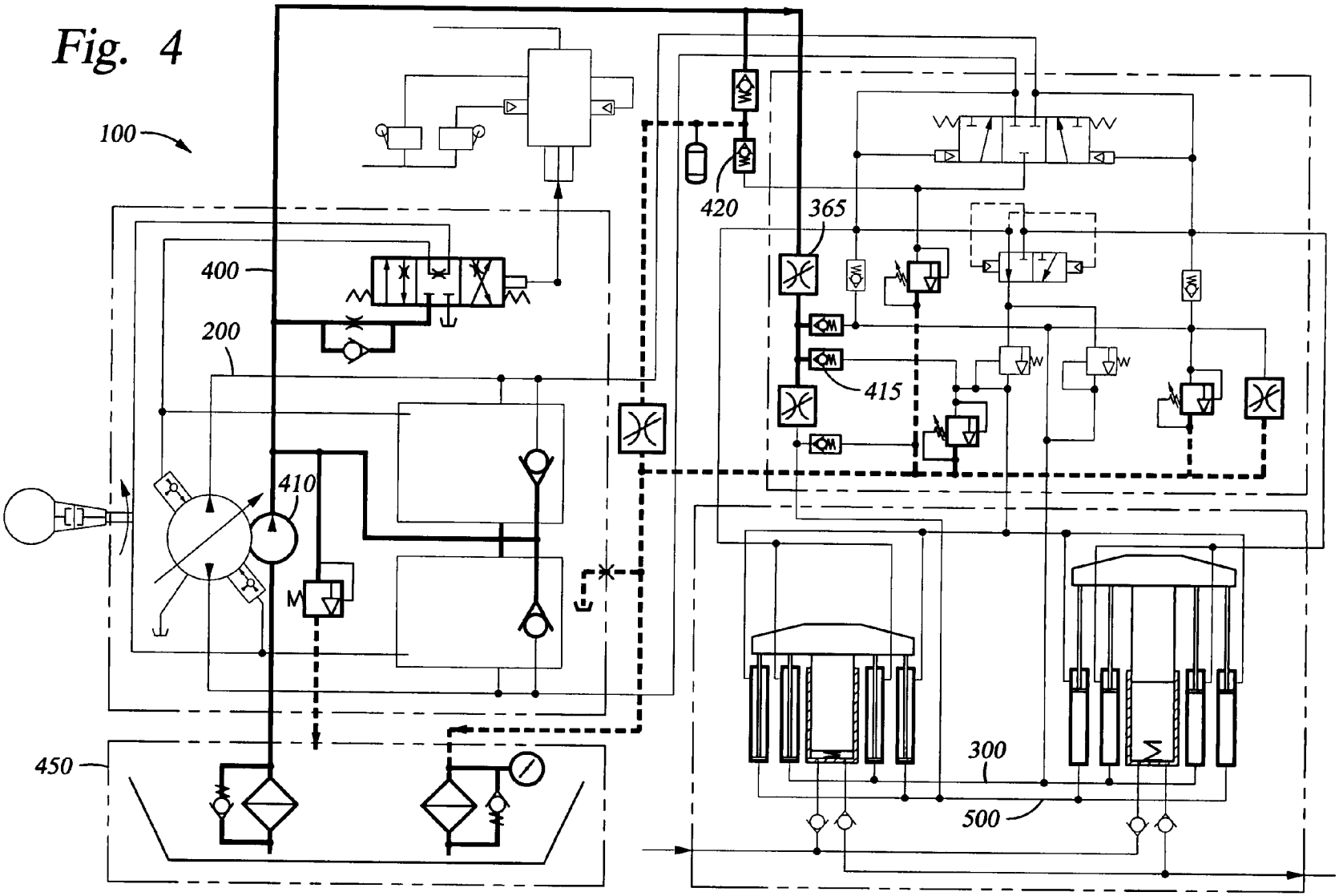
FIG. 4 is a schematic view showing a charging circuit in the hydraulically driven multiphase pump system.

FIG. 4 is a schematic view showing the charging circuit 400 in the hydraulically driven multiphase pump system 100. This circuit 400 picks up hydraulic fluid from a reservoir 450 and pumps it throughout the circuit 400 to re-supply the closed loop circuit 200, the indexing circuit 300 and the power saving circuit 500 with hydraulic fluid. The charge circuit 400 has a predetermined pressure that is maintained by a charging pump 410. The circuit also includes first 415 and a second 420 pressure sensing member. If the closed loop circuit pressure falls below the predetermined charge circuit pressure the first pressure sensing member 420 causes the introduction of hydraulic fluid into the close loop circuit 200 to replenish its supply of fluid. If the indexing circuit pressure falls below the predetermined charge circuit pressure the second pressure sensing member 415 causes the introduction of hydraulic fluid to flow into the indexing circuit 300 to replenish its supply of fluid. A hand operated valve 365 allows selective fluid communication from the charge circuit 400 to the indexing circuit 300. Any fluid not needed by the system 100 is surplus, and is returned to the reservoir 450.

Figure 5:
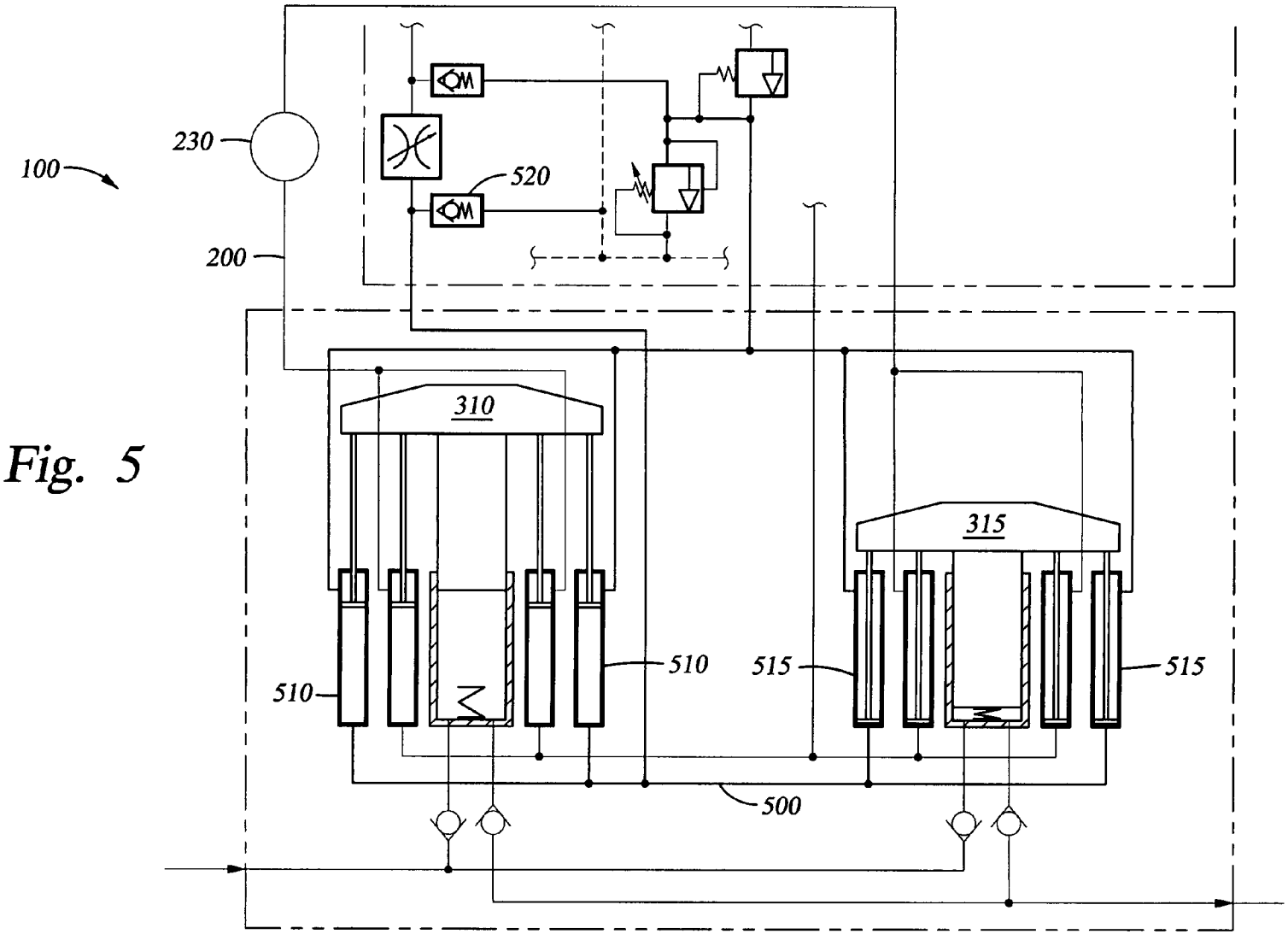
FIG. 5 illustrates a power saving circuit in the hydraulically driven multiphase pump system.

FIG. 5 illustrates the power saving circuit 500 in the hydraulically driven multiphase pump system 100. Circuit 500 will transfer energy between the plungers, 310, 315 as they move in opposite directions. The power saving circuit 500 includes a first and second power saving hydraulic cylinders 510 disposed adjacent to the first plunger 310 connected to a first and second power saving hydraulic cylinders 515 disposed adjacent to the second plunger 315. In high inlet pressure scenarios, the plunger moving toward the extended position is urged upwards by the inlet pressure of the fluidstream resulting in useful energy. This energy is transferred from the plunger moving toward its extended position to the plunger moving toward its preset retracted position by the power saving hydraulic cylinders 510, 515. Therefore, the amount of work needed from the pressure compensated pump 230 in the closed loop circuit 200 directed to the plunger moving toward the preset retracted position is substantially reduced. In low inlet pressure scenarios, the power saving circuit 500 in same manner as previously described may be economically applied where the plunger diameter is large thereby having a large surface area to act upon. Any excess fluid in the circuit 500 may be relieved to the reservoir 450 through valve 520. While the described embodiment in FIG. 5 includes hydraulic cylinders 510, 515, it will be understood that any mechanism that facilitates the transfer of energy such as sheaves, chains, or hydraulic cylinders could be used. Additionally, this invention is not limited to the orientation of the hydraulic cylinders as shown on FIG. 5 but rather may be disposed in any orientation that is necessary and effective.

Figure 6:
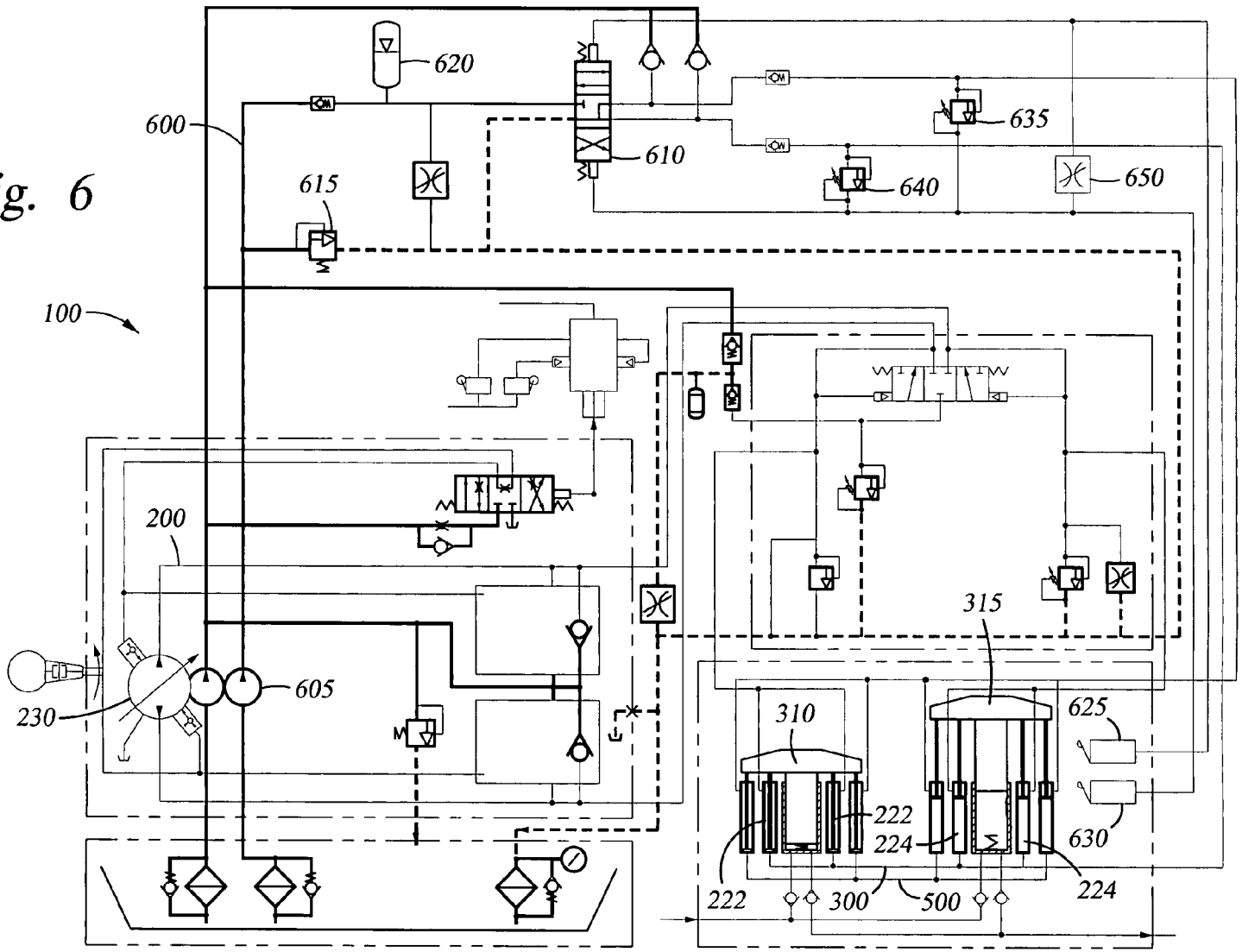
FIG. 6 illustrates a trim circuit in the hydraulically driven multiphase pump system.

FIG. 6 illustrates a trim circuit 600 in the hydraulically driven multiphase pump system 100. Generally, the trim circuit 600 provides fluid to the indexing circuit 300 and the power saving circuit 500. The trim circuit 600 includes a pump 605, such as a gear pump, that is operatively attached to the pump 230. The pump 605 supplies fluid to the trim circuit 600. The trim circuit 600 further includes a directional control valve 610 for controlling the fluid through the circuit 600. In the normal position (as illustrated), the control valve 610 restricts fluid flow to the indexing circuit 300 and the power saving circuit 500 causing fluid to accumulate in an accumulator 620 and eventually flow through a relief valve 615. After the fluid in the accumulator 620 reaches a predetermined pressure, the valve 610 may be opened to allow fluid to flow into indexing circuit 300 and the power saving circuit 500. The trim circuit 600 further includes a first limit switch 625 and a second limit switch 630. The limit switches 625, 630 are generally used to selectively trigger the valve 610 to direct fluid into the indexing circuit 300 or into the power saving circuit 500. More specifically, after the first limit switch 625 is triggered by a predetermined control such as a PLC (not shown), the valve 610 allows fluid to enter into the power saving circuit 500 which has the effect of shortening or adjusting the maximum stroke between the two plungers 310, 315. On the other hand, after the second limit switch 630 is triggered by a predetermined control such as the PLC, the valve 610 allows fluid to enter into the indexing circuit 300 which assures the ascending plunger will reach its full stroke and maintain the counter-synchronous relationship between the plungers 310, 315. The trim circuit 600 further includes relief valves 635 and 640 to limit the maximum pressure in the power saving circuit 500 and the indexing circuit 300, respectfully. The trim circuit 600 also includes a needle valve 640 to drain the circuit or adjust the frequency of adding fluid into the power saving circuit 500.

Figure 7:
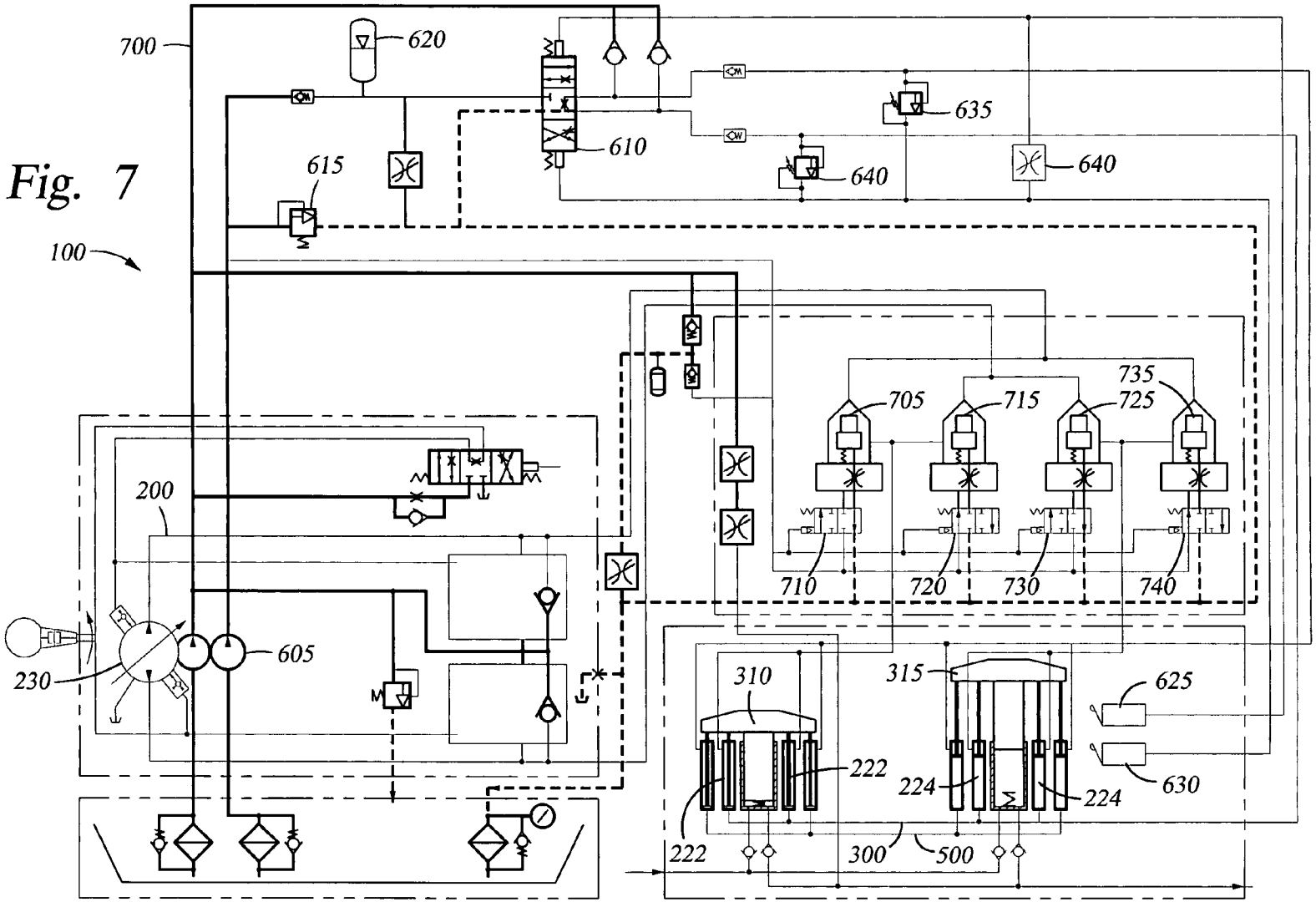
FIG. 7 illustrates a rapid reversal circuit in the hydraulically driven multiphase pump system.

FIG. 7 illustrates a rapid reversal circuit 700 in the hydraulically driven multiphase pump system 100. Generally, the rapid reversal circuit 700 provides a means for rapidly changing the direction of the plungers 310, 315. In other words, instead of relying on the pump 230 to reverse its flow and subsequently the direction of the plungers 310, 315, the rapid reversal circuit 700 uses a plurality of poppet valves 705, 715, 725, 735 to change the direction of the plungers 310, 315. Each poppet valve 705, 715, 725, 735 includes a respective control valve 710, 720, 730, 740 to selectively control the flow of fluid into and out of the poppet valve. More specifically, when each control valve 710, 720, 730, 740 is energized fluid enters the poppet valve and when each control valve 710, 720, 730, 740 is de-energized fluid exits the poppet valve and subsequently drains to the tank.

In operation, the rapid reversal circuit 700 controls the direction of the plungers 310, 315 by selectively energizing each control valve 710, 720, 730, 740 after a limit switch (not shown) is triggered. For instance, as plunger 315 has descended, it will cause pilot pressure to flow into poppet valves 715, 735 and allow pressure to exit out of poppet valves 705, 725. Preferably, the poppet valve is closed when pilot pressure is introduced therein and closed when relieved from pilot pressure. Therefore, as poppet valve 715 opens the high pressure from the pressure compensated pump 230 flows into the cylinders 222 of plunger 310, thereby causing the plunger 310 to descend. At the same time, plunger 315 will ascend and cause fluid to flow through the poppet valve 735 back to the inlet of the pressure compensated pump 230. Subsequently, plunger 310 triggers its limit switch thereby causing the control valves 710, 720, 730, 740 to reset and allow the fluid flow from the pressure compensated pump 230 to be directed through the poppet valve 725 while flow back from plunger 315 returns through poppet 705. Preferably, a PLC control (not shown) controls the opening and closing sequence and uses the throttling settings on each poppet valve 705, 715, 725 to control the rate that the poppet valve moves. These control settings determine the rate the plungers 310, 315 reverse direction.

While the foregoing is directed to embodiments of the present invention, other and further embodiments of the invention may be devised without departing from the basic scope thereof, and the scope thereof is determined by the claims that follow.

The invention claimed is:

1. A fluid pumping system comprising:

a pair of substantially counter synchronous fluid pumps;

a power fluid circuit for providing power fluid to and from the pair of fluid pumps, the power fluid circuit having a primary pump, wherein the pump comprises a pressure compensating pump chamber;

an indexing circuit for regulating the fluid in the power fluid circuit by introducing and removing fluid in the power fluid circuit throughout a pump cycle to allow one fluid pump to reach a full extended position prior to other fluid pump reaching a retracted position; and a trim circuit for providing fluid to the indexing circuit to ensure the pair of fluid pumps remain in substantially counter synchronous operation.

2. The fluid pumping system of claim 1, wherein the pair of substantially counter synchronous fluid pumps are a pair of plungers, each plunger movable between an extended position and a retracted position.

3. The fluid pumping system of claim 2, wherein at least one plunger is moved by a fluid operated cylinder.

4. The fluid pumping system of claim 3, wherein the power fluid circuit further includes a pump, a signal box and at least one pair of limit switches for controlling the direction of fluid in the circuit.

5. The fluid pumping system of claim 4, wherein the pair of limit switches are constructed and arranged to trigger the signal box upon arrival of one of the fluid pumps at the retracted position, thereby causing the pump to redirect the flow of fluid in the power fluid circuit.

6. The fluid pumping system of claim 4, whereby the pair of limit switches is adjustable to determine the retracted position of the fluid pump.

7. The fluid pumping system of claim 1, further including a rapid reversal circuit to control the rate and direction of the pair of counter synchronous fluid pumps.

8. The fluid pump system of claim 7, wherein the rapid reversal circuit includes at least one poppet valve.

9. The fluid pumping system of claim 1, wherein the indexing circuit further includes an acceleration valve in selective communication with the power fluid circuit and the indexing circuit.

10. The fluid pumping system of claim 9, wherein the acceleration valve is constructed and arranged to selectively redirect fluid from the fluid power circuit to the indexing circuit as the fluid pumping system completas a cycle and one of the fluid pumps moves from the extended position to the retracted position.

11. The fluid pumping system of claim 1, further including a charge circuit for providing fluid to the power fluid circuit and the indexing circuit.

12. The fluid pumping system of claim 11, wherein the charge circuit inciudes at least one pressure sensing member for introducing fluid into the power fluid circuit or the indexing circuit when the pressure in any one or more circuits falls below the charge circuit pressure.

13. The fluid pumping system of claim 12, further including at least one biasing member for biasing one of the fluid pumps as the fluid pump moves from the retracted position.

14. The fluid pumping system of claim 10, wherein the biasing member urges the fluid pump towards the extended position, thereby lowering a pressure in the indexing circuit below a pressure in the charge circuit, thereby causing the charge circuit to introduce fluid to the indexing circuit.

15. The fluid pumping system of claim 11, wherein the power fluid circuit further includes a valve member and an accumulator for ensuring adequate fluid in the power fluid circuit.

16. The fluid pumping system of claim 15, wherein the accumulator stores fluid from the charge circuit and the valve member is arranged between the accumulator and the power fluid circuit to permit fluid introduction to the power fluid circuit in the event that fluid pressure in the circuit falls below a preset valve.

17. The fluid pumping system of claim 1, whereby the trim circuit is configured to introduce fluid into a power saving circuit to allow a transfer of energy between the pair of substantially counter synchronous fluid pumps during the pump cycle.

18. A fluid pumping system, comprising:

a first and a second plunger;

a pressure compensated fluid pump for providing power fluid to and from the plungers;

an indexing pump configured to regulate the fluid in the pressure compensated fluid pump by introducing and removing fluid in the pressure compensated fluid pump throughout a pump cycle, wherein the pressure compensated fluid pump compensates for such introducing and removing, thereby allowing one plunger to reach a full extended position prior to other plunger reaching a retracted position; and a rapid reversal circuit having at least one poppet valve and at least one control valve attached to each plunger, whereby the valves are configured to control the directional movement of each plunger during the pump cycle.

19. A method for pumping a fluidstream comprising:

moving a pair fluid pumps between an extended position and a retracted position by utilizing a fluid power circuit;

introducing and removing fluid in the power fluid circuit via a indexing circuit throughout a pump cycle to allow one fluid pump to reach a full extended position prior to other fluid pump reaching the retracted position; and introducing fluid into the indexing circuit via a trim circuit to maintain a substantially counter-synchronous relationship between the fluid pumps.

20. The method of claim 19, further including lowering a pressure in the indexing circuit below a pressure in a charge circuit to cause the charge circuit to introduce fluid to the indexing circuit.

21. The method of claim 20, further including dynamically compensating for the introducing and removing of fluid within the power fluid circuit.

* * * * *

UNITED STATES PATENT AND TRADEMARK OFFICE

CERTIFICATE OF CORRECTION

PATENT NO. : 7,175,394 B2
APPLICATION NO. : 10/621108
DATED : February 13, 2007
INVENTOR(S) : Bryan Virge Butler It is certified that error appears in the above-identified patent and that said Letters Patent is hereby corrected as shown below:

In the Claims section:

In column 8, Claim 10, line 49, please delete "completas" and insert --completes--.
In column 8, Claim 12, line 56, please delete "inciudes" and insert --includes--.
In column 8, Claim 14, line 63, after "claim", please delete "10" and insert --13--.

Signed and Sealed this

Tenth Day of July, 2007

JON W. DUDAS
*Director of the United States Patent and Trademark Office*